US008099841B2

(12) United States Patent
Dilo

(10) Patent No.: US 8,099,841 B2
(45) Date of Patent: Jan. 24, 2012

(54) NEEDLE BOARD FOR A NEEDLE MACHINE

(75) Inventor: Johann Philipp Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 299 days.

(21) Appl. No.: 12/490,007

(22) Filed: Jun. 23, 2009

(65) Prior Publication Data

US 2010/0162543 A1 Jul. 1, 2010

(30) Foreign Application Priority Data

Jun. 24, 2008 (EP) ..... 080114143

(51) Int. Cl.
*D04H 18/00* (2006.01)

(52) U.S. Cl. ..... 28/115

(58) Field of Classification Search ..... 28/107, 28/115, 111, 114, 109, 108, 110, 112, 113; 112/80.4, 80.45
See application file for complete search history.

(56) References Cited

U.S. PATENT DOCUMENTS

| | | | | | |
|---|---|---|---|---|---|
| 2,896,303 | A | * | 7/1959 | Morrill | 28/115 |
| 3,680,182 | A | | 8/1972 | Scott | |
| 3,877,120 | A | * | 4/1975 | Okamoto et al. | 28/115 |
| 5,117,541 | A | * | 6/1992 | Leuchtenmuller | 28/115 |
| 5,148,584 | A | * | 9/1992 | Fehrer | 28/115 |
| 6,003,215 | A | * | 12/1999 | St. Jacques | 28/115 |
| 6,145,176 | A | * | 11/2000 | Egnaczak et al. | 28/107 |

FOREIGN PATENT DOCUMENTS

| | | | |
|---|---|---|---|
| DE | 102005034144 | B3 | 12/2006 |
| EP | 1391546 | A1 | 2/2004 |
| GB | 399104 | A | 9/1933 |

* cited by examiner

*Primary Examiner* — Amy Vanatta

(74) *Attorney, Agent, or Firm* — Jansson Shupe & Munger Ltd.

(57) ABSTRACT

The needle board for a needling machine has a base plate with a plurality of receptacles, and a plurality of needle modules. Each needle module has a carrier plate, which is equipped with a plurality of needles arranged in a predetermined pattern and which is inserted into one of the receptacles in the base plate in such a way that the needles project from the base plate.

22 Claims, 8 Drawing Sheets

NEEDLE BOARD FOR A NEEDLE MACHINE

CROSS REFERENCE TO RELATED APPLICATION

This application claims priority based on European patent application 08 011 414.3, filed Jun. 24, 2008.

FIELD OF THE INVENTION

The present invention pertains to a needle board for a needling machine, in which a plurality of needles is arranged in a predetermined pattern in the area of the base plate and the tips of the needles project from the base plate.

BACKGROUND

Needling machines are generally known and are described in, for example, "Vliesstoffe" ("Nonwovens"), by Lünenschloβ and Albrecht, Georg-Thieme-Verlag, Stuttgart, 1982, pp. 122-129.

The needle boards used in a needling machine of this type usually consist of a base plate of aluminum with bores, from which the needles project, and a plastic plate, made especially of polyamide (Nylon), which is attached to the back of the base plate and which is provided with a corresponding set of bores. Grooves, to which the bores lead, are milled into the back of the plastic plate. The grooves serve to accept the bent-over sections of the needles shafts located at the tear of the needles. The bores in a needle board of this type are closely matched to the diameters of the shafts of the needles held in the needle board, so that the needles are seated as firmly as possible in the needle board and do not wobble during use. The back of the needle board lies on the needle bar of the needling machine, to which it is attached, as a result of which the bent-over sections of the needles are held in the grooves.

Because the service life of needles is limited, they must be replaced from time to time. The process of inserting the needles into the needle board and of removing them from the board again, however, has the effect of wearing down the bores and thus of loosening the fit between the needle shaft and the bore in the aluminum base plate of the needle board to such an extent that eventually there is no longer enough clamping force present. The needles can therefore wobble in the bores and are bent out of shape during the needling process and can even break off.

Another disadvantage of these types of needle boards is that inserting the needles into the boards is a very tedious task, and thus the replacement of a needle board or the replacement of the needles in the needle board is always associated with a considerable amount of labor and with high cost.

SUMMARY OF THE INVENTION

It is an object of the present invention to provide a needle board for a needling machine which can be produced easily, which offers a long service life, and in which a replacement of defective needles or the installation of a full set of new needles can be accomplished easily and cost effectively.

According to an aspect of the invention, the needle board for a needling machine comprises a base plate having a plurality of receptacles, and a plurality of needle modules, wherein each needle module comprises a carrier plate, which is equipped with a plurality of needles arranged in a predetermined pattern and which is inserted into one of the receptacles in the base plate in such a way that the needles project from the base plate.

This guarantees that defective needles can be replaced very easily, that entire needle boards can be quickly and easily reequipped, and that the service life of a needle board is increased.

The receptacles are preferably designed as slots in the base plate. The slots can be formed by a simple processing step, which further simplifies the production of the needle board.

So that any downward movement of the carrier plates can be reliably prevented under high accelerations of the needle board, the carrier plates can preferably comprise a projecting edge section, which rests on a shoulder in a wall area of the corresponding receptacle in the base plate.

To ensure uniform contact, it is advantageous for the projecting edge section and the shoulder to extend all the way around their periphery.

To reduce the weight of the needle board and to simplify the production of the needle modules, the carrier plates are preferably made of plastic.

An especially simple production method consists of casting or injection-molding the carrier plates onto the needles. Alternatively, the needles can be inserted into bores in prefabricated carrier plates.

To prevent the needles from shifting inside the bores, the needles can preferably have mushroomed or angled heads. The shafts of the needles can also be roughened.

The needles can be arranged within a needle module in many ways, and a wide variety of arrangements of the various needle modules in the base plate is also conceivable.

The method for the production of a needle board for a needling machine includes providing a base plate having a plurality of receptacles and providing a plurality of needle modules, each of which have a carrier plate which is equipped with a plurality of needles. The needle modules are inserted into the receptacles in the base plate.

BRIEF DESCRIPTION OF THE DRAWINGS

The invention is explained in greater detail below with reference to the exemplary embodiments illustrated in the drawings.

DETAILED DESCRIPTION OF THE INVENTION

Figure 1:
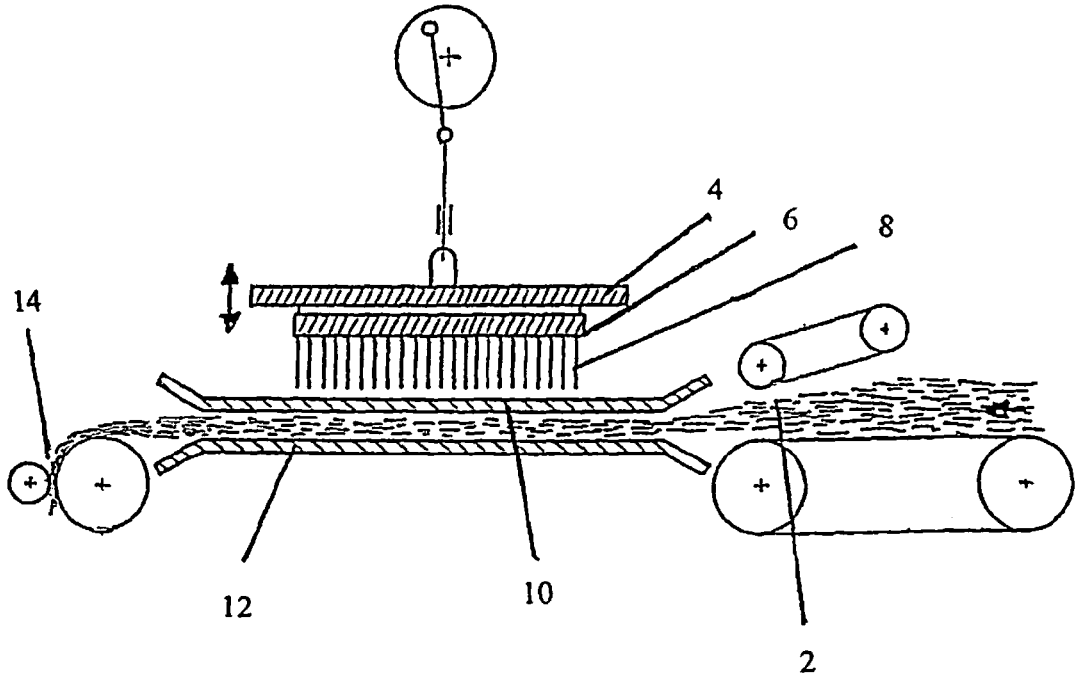
FIG. 1 is a schematic diagram of the basic design of a simple needling machine.

FIG. 1 shows the design of a needling machine in schematic fashion. A web of nonwoven 2 is supplied to the infeed section of the needling machine and conveyed to the needling zone. In the area of the needling zone, a needle bar 4 is positioned and attached to a needle board 6. Needle board 6 is equipped with needles 8 to strengthen the nonwoven. In this area, nonwoven 2 to be needled is guided between a hold-down plate 10 and a needle plate 12. Needles 8 increase the density of nonwoven 2 by being inserted into the nonwoven and pulled back out again at high frequency. As this is happening, they pass through openings in hold-down plate 10 and in needle plate 12. The resulting product is an interlocked nonwoven 14. Those skilled in the art are familiar with a wide variety of different forms of needling machines, including double-needle machines, in which two needle bars are used for needling, one acting from above and the other from below, and needling machines in which the needle bars are moved along in the direction of movement of the nonwoven during the interlocking process.

Figure 2:
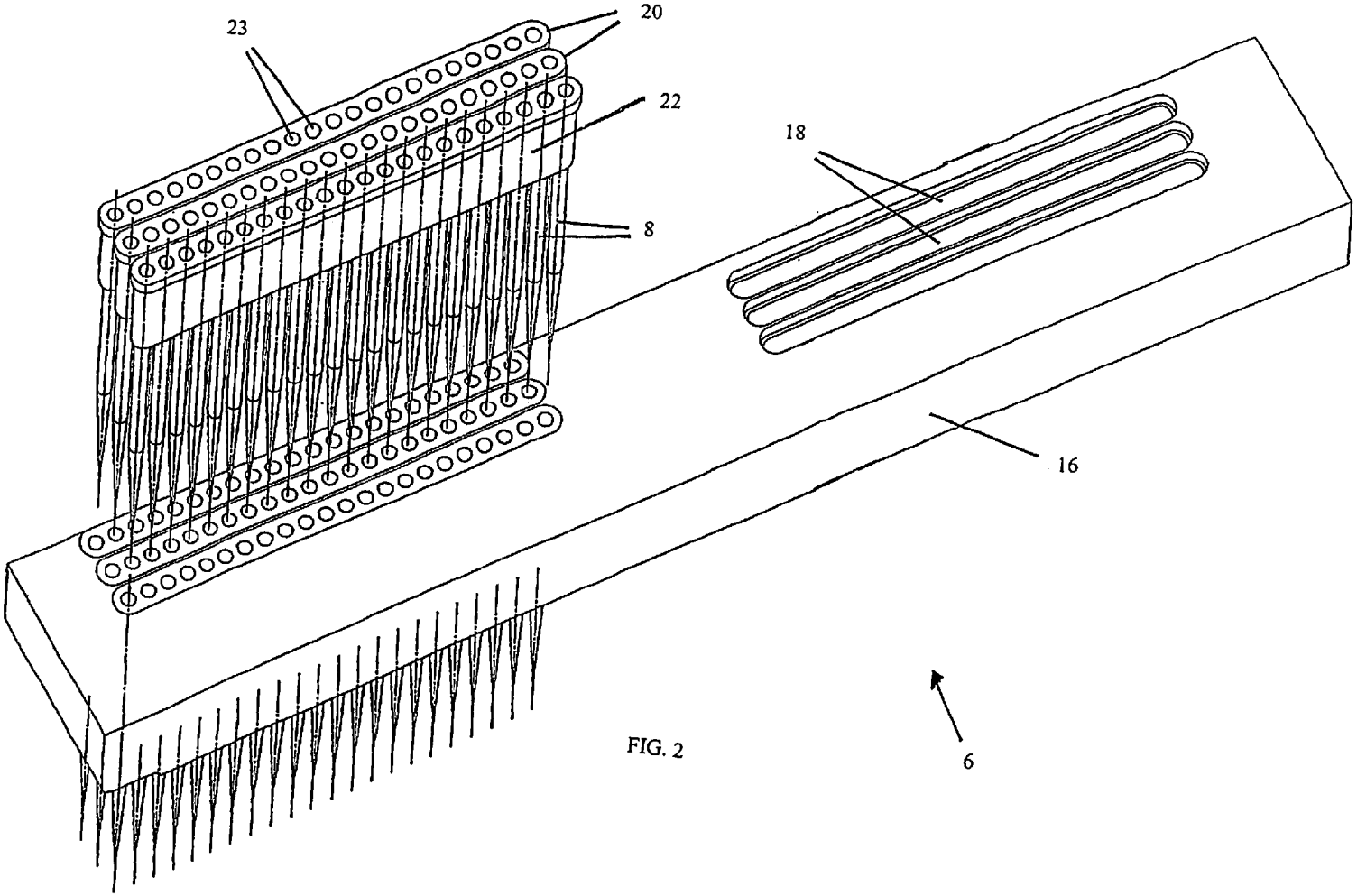
FIG. 2 is a perspective view of a first embodiment of the needle board according to the present invention with three needle modules equipped with needles, wherein the needle modules are shown both in a state before and in a state after insertion into the needle board.
Figure 3:
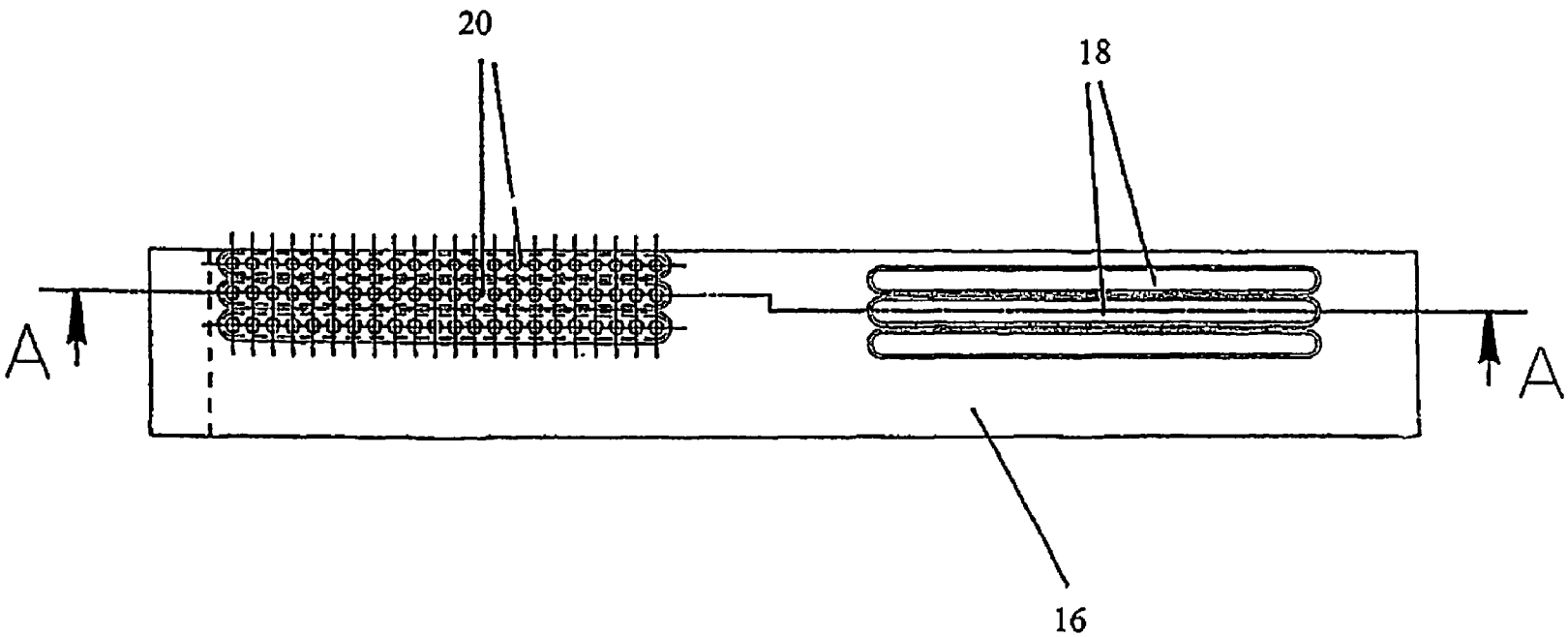
FIG. 3 is a top view of the needle board of FIG. 2.
Figure 4:
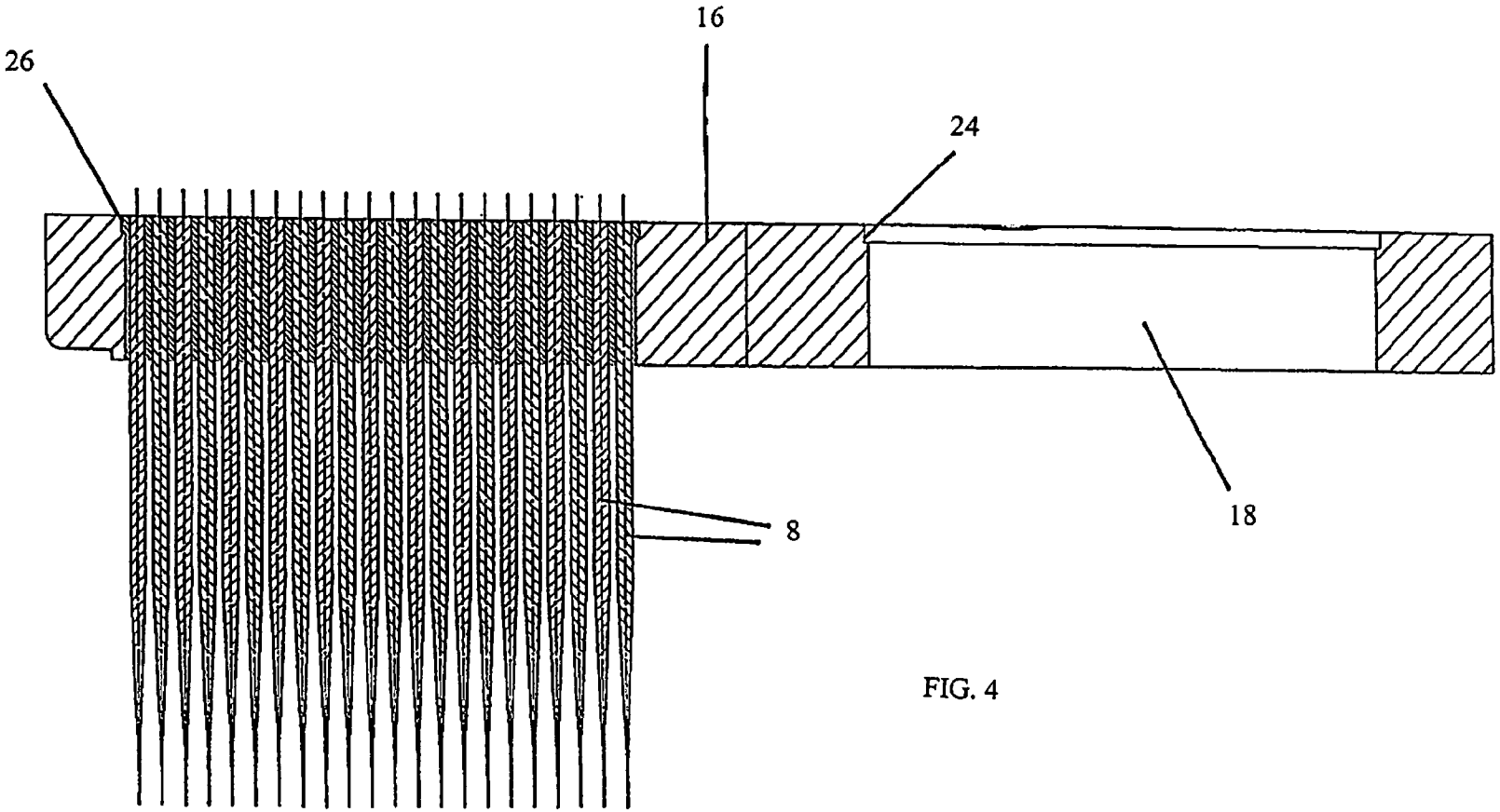
FIG. 4 is a cross-sectional view of the needle board along line A-A of FIG. 3.

Needle board 6 according to the present invention can be used in any type of needling machine. FIGS. 2-4 show a first preferred embodiment of needle board 6 according to the present invention.

Needle board 6 comprises a base plate 16, in which a plurality of receptacles 18 is formed. Receptacles 18 are designed and illustrated in FIGS. 2-4 in the form of long slots. Base plate 16 consists preferably of aluminum, but other materials such as magnesium, etc. are also possible. A needle module 20 is introduced into each of the slots 18 so that needles 8 extend through base plate 16 and project from needle board 6 on its side opposite the side where slots 18 are arranged. Each needle module 20 has a carrier plate 22, which comprises a plurality of bores 23 into each of which a needle 8 is inserted.

FIG. 2 shows three needle modules 20 in a state apart from needle board 6 and also in a state after introduction into needle board 6. For the sake of clarity, three slots 18 of needle board 6 are shown in the unfilled state on the right side of FIG. 2.

Needle modules 20 are introduced into slots 18 and held there in positive fashion, wherein carrier plates 22 are positioned within slots 18 in the base plate. As can be seen in FIG. 4, each slot 18 includes a peripheral shoulder 24 in its wall area, on which a projecting edge section 26 of carrier plate 22 rests after carrier plate 22 has been inserted into slot 18. If needle board 6 is not subject to extremely high accelerations, shoulder 24 and projecting edge section 26 can be omitted. In this case, the force required to hold needle modules 20 in base plate 16 will be produced by a friction-locking connection. A conical tapering of slots 18 in the direction toward their lower edge in cooperation with a corresponding shape of carrier plates 22 would also be possible.

Needles 8 may have angled heads (not shown), which, for example, lie in a correspondingly shaped groove in carrier plate 22. The heads of needles 8 may be flush with the outside surface of carrier plate 22.

Alternatively, needles 8 can merely be held in place by the clamping forces of the fit between the shaft of needle 8 and carrier plate 22. The head of each needle 8 could also be mushroomed, so that a positive-locking connection is provided. The shall of each needle can be roughened.

Needles 8 can be installed in needle modules 20 in the standard manner simply by pushing them in, or the needles can be provided in a predetermined pattern, and then carrier plate 22 can be cast or injection-molded around them.

To simplify both the insertion of needles 8 into carrier plate 22 and the insertion of carrier plates 22 into slots 18, automatic pick-and-place machines can be provided. Such automatic machines may perform these standardized processes without manual effort. It is also conceivable that both processes could be performed by the same automatic machine. An example of the automated insertion of carrier plates 22 into slots 18 is described in greater detail below with reference to FIG. 5.

The alternative method of casting or injection-molding carrier plate 22 of plastic onto needles 8 can also be carried out preferably automatically.

In the example shown in FIGS. 2-4, three needle modules 20 are arranged to form a group, wherein each needle module 20 contains one row of needles 8. Any other geometric arrangement of the needles within a needle module 20 is also possible, however, and the arrangement of the different needle modules 20 with respect to each other can also be varied as desired.

Figure 5:
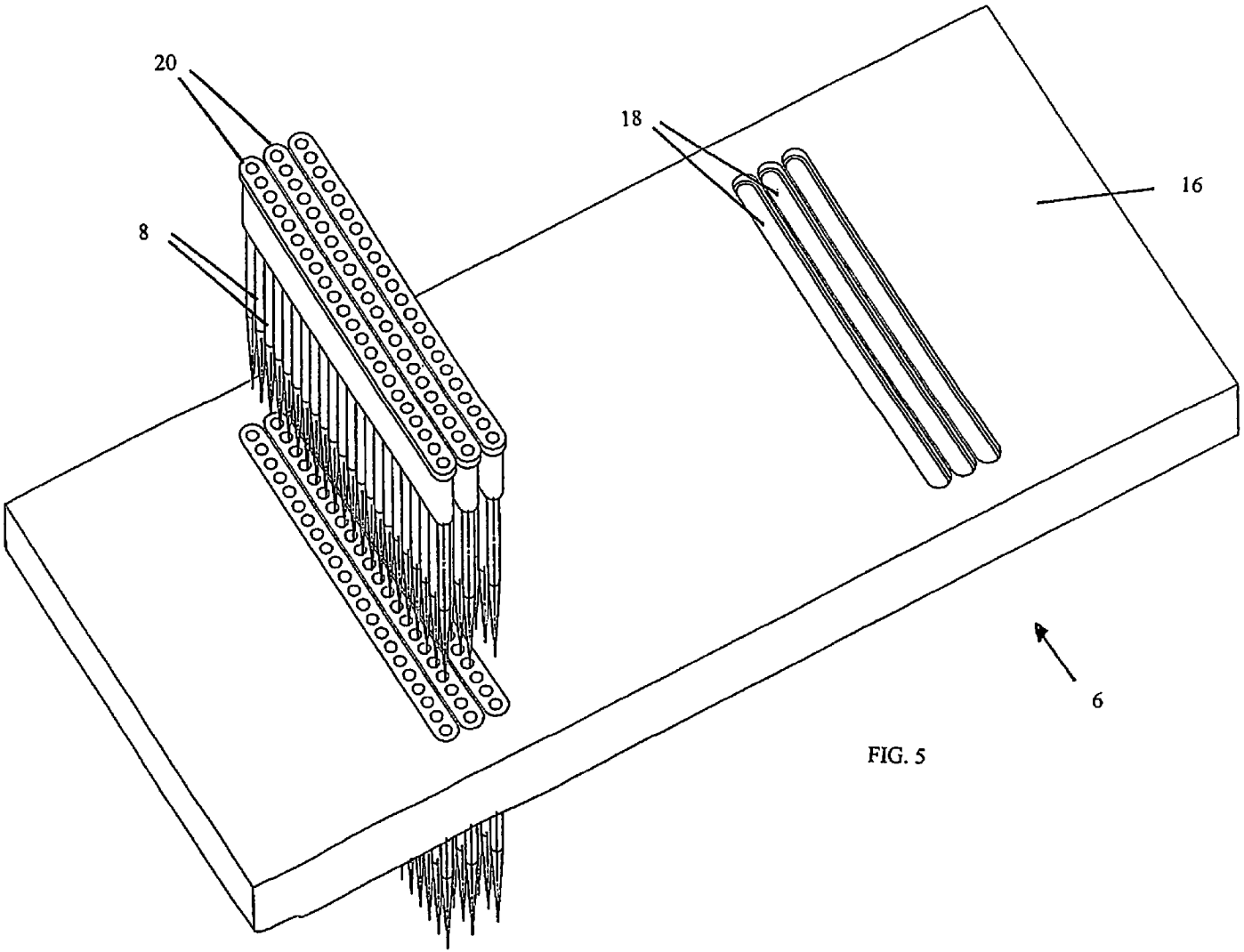
FIG. 5 is a perspective view of a second embodiment of the needle board according to the invention with three needle modules equipped with needles, wherein the needle modules are shown both in a state before and in a state after insertion into the needle board.
Figure 6:
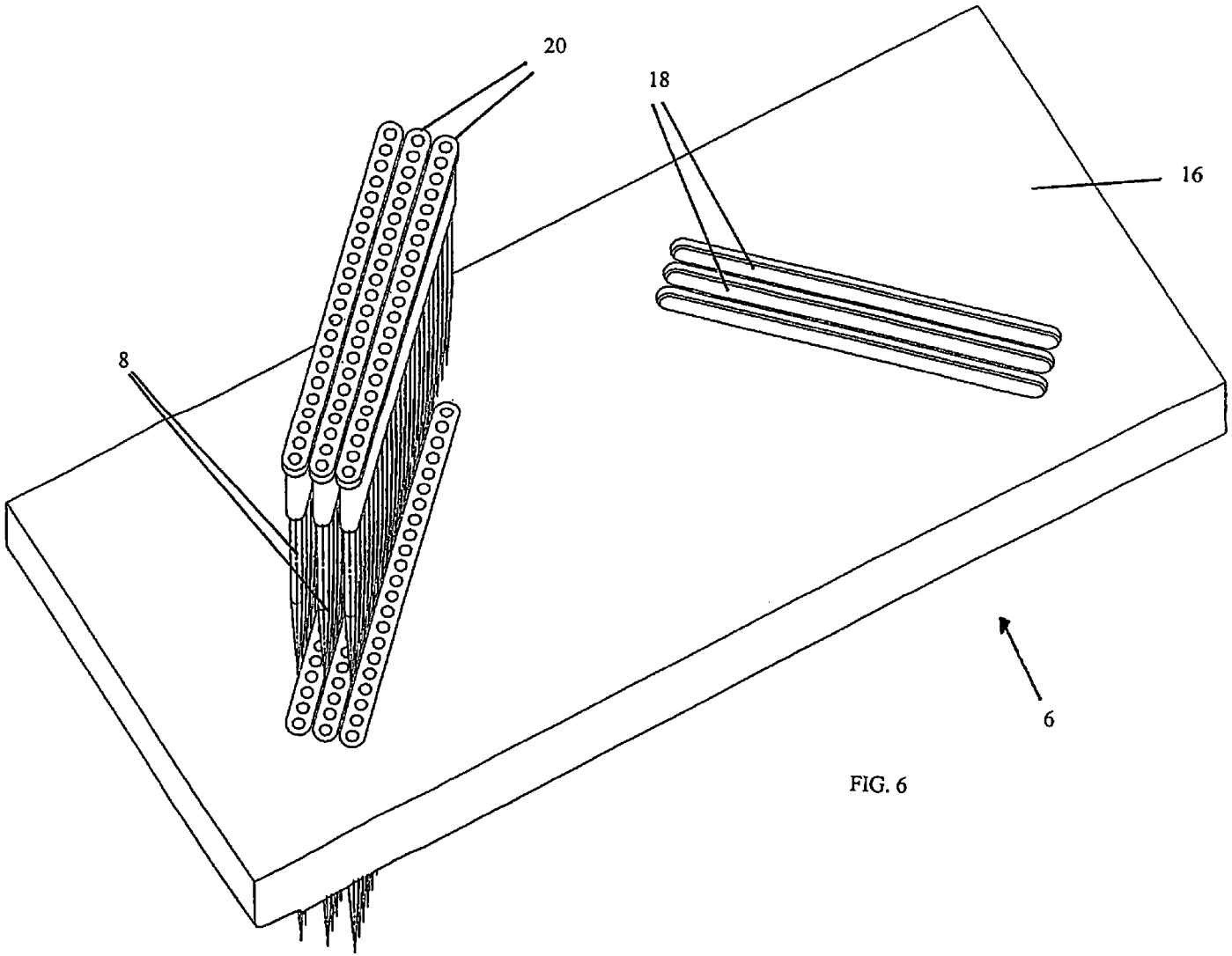
FIG. 6 is a perspective view of a third embodiment of the needle board according to the invention with three needle modules equipped with needles, wherein the needle modules are shown both in a state before and in state after insertion into the needle board.
Figure 7:
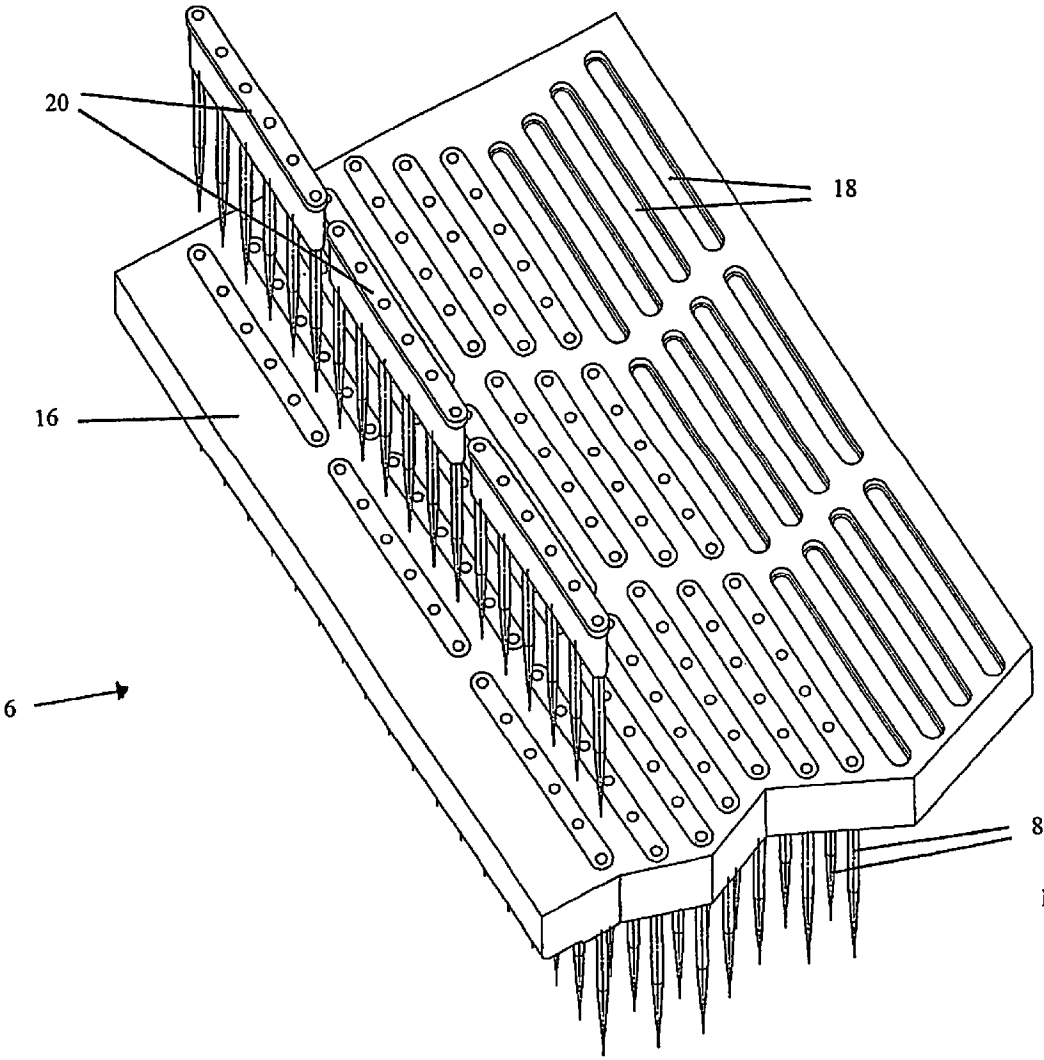
FIG. 7 is a perspective view of a fourth embodiment of the needle board according to the invention with several needle modules equipped with needles, wherein the needle modules are shown both in a state before and in a state after insertion into the needle board.

In the preferred embodiment illustrated in FIGS. 2-4, needles 8 are arranged in rows extending in the same direction as that in which the nonwoven travels. The embodiments according to FIGS. 5-7 show other orientations. In FIG. 5, needles 8 are arranged in rows extending transversely to the travel direction of the nonwoven, and in FIG. 6 they are arranged at an angle to that direction. FIG. 7 does not show an arrangement of the individual needle modules 20 into groups but rather an offset arrangement of the individual needle modules 20 in a pattern.

Slots 18 can also show other orientations, and receptacles 18 in base plate 16 can also have any other desired shape. The material of carrier plate 22 is preferably a rigid plastic, which can be reinforced with fiberglass. Carrier plates 22 can be flat in design so that they can be installed in flat needle boards 6, or they can be curved in design so that they can be installed in curved needle boards 6. Nevertheless, it is also possible to install flat carrier plates 22 in curved needle boards 6, because needle board 6 will be aligned so that it is parallel to the nonwoven web when needle board 6 is attached to needle bar 4.

The modular structure of needle board 6 according to the invention gives the user the ability to load needles 8 into needle board 6 or to replace them very quickly.

Figure 8:
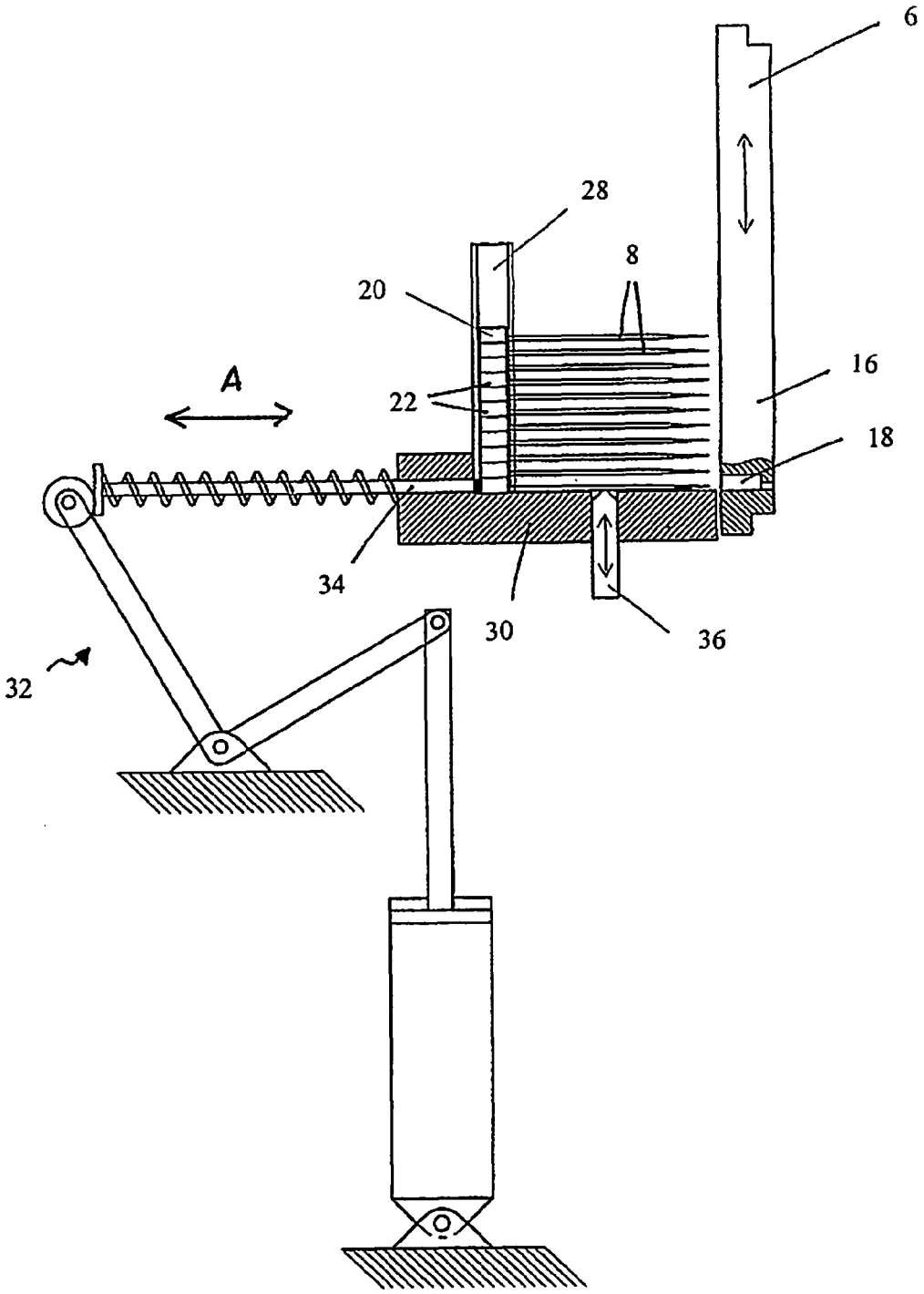
FIG. 8 is a cross-sectional view of a device for the automatic insertion of needle modules into the base plate of the needle board.

FIG. 8 shows by way of example a device for the automatic insertion of needle modules 20 into base plate 16 of needle board 6. The machine comprises a supply shall 28, in which needle modules 20 are, for example, stacked on top of each other in a vertical arrangement. It is preferable for supply shall 28 to move along needle board 6 out of the plane of the drawing, and back into that plane again. Alternatively, needle board 6 can also be set up to be movable. Needle modules 20 preferably rest on a smooth table 30. An insertion device 32 comprises a plunger 34, which moves back and forth along arrow A, and which preferably is actuated pneumatically to push needle module 20 located in the lowermost position into needle board 6. During the insertion process, smooth plunger 34 prevents needle module 20 next in line in the stack from sliding down.

To improve the positioning in the horizontal or even in the vertical direction guide pins (not shown) can be provided, which are parallel to needles 8 and each of which engages in a free slot 18 in base plate 16 of needle board 6 to align supply shall 28 with needle board 6 in correspondence with the pattern of slots 18.

During the insertion process a vertically movable pin 36 can, if desired, support needles 8 until carrier plate 22 has to slide across pin 36 or until the tips of needles 8 have entered slots 18.

Many possible ways of executing the insertion process are conceivable. For example, the needle board can be completely immobilized and only supply shall 28 can be moved. The movement can also be divided, so that, for example, supply shaft 28 is moved only in the horizontal direction along needle board 6, whereas needle board 6 itself supplies the second component of the movement, namely, the vertical component.

While the invention has been described and illustrated in conjunction with specific preferred embodiments, it will be evident that many alternatives, modifications, variations and combinations will be apparent to those skilled in the art. Any such changes may be made without departing from the spirit and scope of the invention. The described and illustrated embodiments are to be considered in all respects only as illustrative and not restrictive. These and all similar modifications and changes are considered to be within the scope of the present invention.

What is claimed is:

1. A needle board for a needling machine, comprising:

a base plate having a plurality of receptacles designed as slots, and a plurality of needle modules, wherein each needle module comprises a carrier plate, which is equipped with a plurality of needles arranged in at least one row and which is positioned within one of the receptacles in the base plate in such a way that the carrier plate does not project from either side of the base plate while the needles project from one side of the base plate, each carrier plate comprising a projecting edge section, which lies on a shoulder in a wall area inside the corresponding receptacle in the base plate, and thus being held in the corresponding receptacle in a positive fashion.

2. The needle board according to claim 1 wherein the projecting edge section and the shoulder extend circumferentially.

3. The needle board according to claim 1 wherein the carrier plates are made of plastic.

4. The needle board according to claim 3 wherein the carrier plates are cast or injection-molded onto the needles.

5. The needle board according to claim 1 wherein the needles comprise a rough needle shaft.

6. The needle board according to claim 1 wherein the needles comprise mushroomed or angled heads.

7. The needle board according to claim 1 wherein the needle modules are arranged in groups in the base plate.

8. The needle board according to claim 7 wherein the groups are arranged with an offset from each other.

9. A needle board for a needling machine, comprising:

a base plate having a plurality of receptacles designed as slots, and a plurality of needle modules, wherein each needle module comprises a carrier plate, which is equipped with a plurality of needles arranged in at least one row and which is positioned within one of the receptacles in the base plate in such a way that the carrier plate does not project from either side of the base plate while the needles project from one side of the base plate, each carrier plate being held in the corresponding receptacle by a friction-locking connection.

10. The needle board according to claim 9 wherein the carrier plates are made of plastic.

11. The needle board according to claim 10 wherein the carrier plates are cast or injection-molded onto the needles.

12. The needle board according to claim 9 wherein the needles comprise a rough needle shaft.

13. The needle board according to claim 9 wherein the needles comprise mushroomed or angled heads.

14. The needle board according to claim 9 wherein the needle modules are arranged in groups in the base plate.

15. The needle board according to claim 14 wherein the groups are arranged with an offset from each other.

16. A needle board for a needling machine, comprising:

a base plate having a plurality of receptacles designed as slots, and a plurality of needle modules, wherein each needle module comprises a carrier plate, which is equipped with a plurality of needles arranged in at least one row and which is positioned within one of the receptacles in the base plate in such a way that the carrier plate does not project from either side of the base plate while the needles project from one side of the base plate, each receptacle conically tapered in a direction towards the one side of the base plate and cooperating with a corresponding shape of the corresponding carrier plate so that the carrier plate is held in the receptacle.

17. The needle board according to claim 16 wherein the carrier plates are made of plastic.

18. The needle board according to claim 17 wherein the carrier plates are cast or injection-molded onto the needles.

19. The needle board according to claim 16 wherein the needles comprise a rough needle shaft.

20. The needle board according to claim 16 wherein the needles comprise mushroomed or angled heads.

21. The needle board according to claim 16 wherein the needle modules are arranged in groups in the base plate.

22. The needle board according to claim 21 wherein the groups are arranged with an offset from each other.

* * * * *